US010357809B2

(12) United States Patent
Montgomery

(10) Patent No.: US 10,357,809 B2
(45) Date of Patent: Jul. 23, 2019

(54) DECONTAMINATION AND CLEANING PROCESS FOR HYDROCARBON CONTAMINATED EQUIPMENT

(71) Applicant: Kixmon Solutions, LLC, Beaumont, TX (US)

(72) Inventor: Blake Montgomery, Lumberton, TX (US)

(73) Assignee: Kixmon Solutions, LLC, Beaumont, TX (US)

( * ) Notice: Subject to any disclaimer, the term of this patent is extended or adjusted under 35 U.S.C. 154(b) by 94 days.

(21) Appl. No.: 15/275,592

(22) Filed: Sep. 26, 2016

(65) Prior Publication Data

US 2018/0085791 A1 Mar. 29, 2018

(51) Int. Cl.

| | |
|---|---|
| ***B08B 3/08*** | (2006.01) |
| ***B08B 9/08*** | (2006.01) |
| ***C11D 3/02*** | (2006.01) |
| ***C11D 3/43*** | (2006.01) |
| ***C10G 75/00*** | (2006.01) |
| ***C11D 11/00*** | (2006.01) |
| ***B08B 9/00*** | (2006.01) |

(52) U.S. Cl.
CPC ..... *B08B 3/08* (2013.01); *B08B 9/00* (2013.01); *B08B 9/08* (2013.01); *C10G 75/00* (2013.01); *C11D 3/02* (2013.01); *C11D 3/43* (2013.01); *C11D 11/0041* (2013.01); *C11D 11/0064* (2013.01); *B08B 2230/01* (2013.01)

(58) Field of Classification Search
CPC ..... B08B 3/08; B08B 2230/01; B08B 9/0327; B01J 2219/00006; C10G 1/004; C10G 49/005; C10G 75/04; C10G 9/16
See application file for complete search history.

(56) References Cited

U.S. PATENT DOCUMENTS

| | | | | |
|---|---|---|---|---|
| 5,356,482 | A | 10/1994 | Mehta et al. | 134/22.1 |
| 5,389,156 | A * | 2/1995 | Mehta | C23G 1/24 134/10 |
| 5,847,247 | A * | 12/1998 | Conte | C07C 2/02 585/10 |
| 6,872,263 | B1 | 3/2005 | Jansen et al. | 134/31 |
| 6,893,509 | B2 | 5/2005 | Sears et al. | 134/19 |
| 9,017,488 | B2 | 4/2015 | Nath et al. | |
| 9,452,941 | B2 | 9/2016 | Sears | |
| 2005/0139238 | A1 * | 6/2005 | Ferrara | B08B 9/00 134/22.11 |

OTHER PUBLICATIONS

Canadian Office Action dated Aug. 20, 2018 of corresponding Canadian Patent Application No. 2,978,544.

* cited by examiner

*Primary Examiner* — Mikhail Kornakov
*Assistant Examiner* — Natasha N Campbell
(74) *Attorney, Agent, or Firm* — Bradley Arant Boult Cummings LLP

(57) ABSTRACT

The present invention relates to a process for removing noxious gases and cleaning hydrocarbon contaminants from equipment at a refinery, plant, or other facility during a turnaround period. The process includes injecting an aromatic solvent into the contaminated equipment with a gas stream, such as steam, and an additive. The combination of the steam and the chemical blend of solvent and additive dissolves harmful hydrocarbon material and removes noxious vapors from the equipment in a manner that is faster, more efficient, and can be performed at a significantly lower cost.

19 Claims, 1 Drawing Sheet

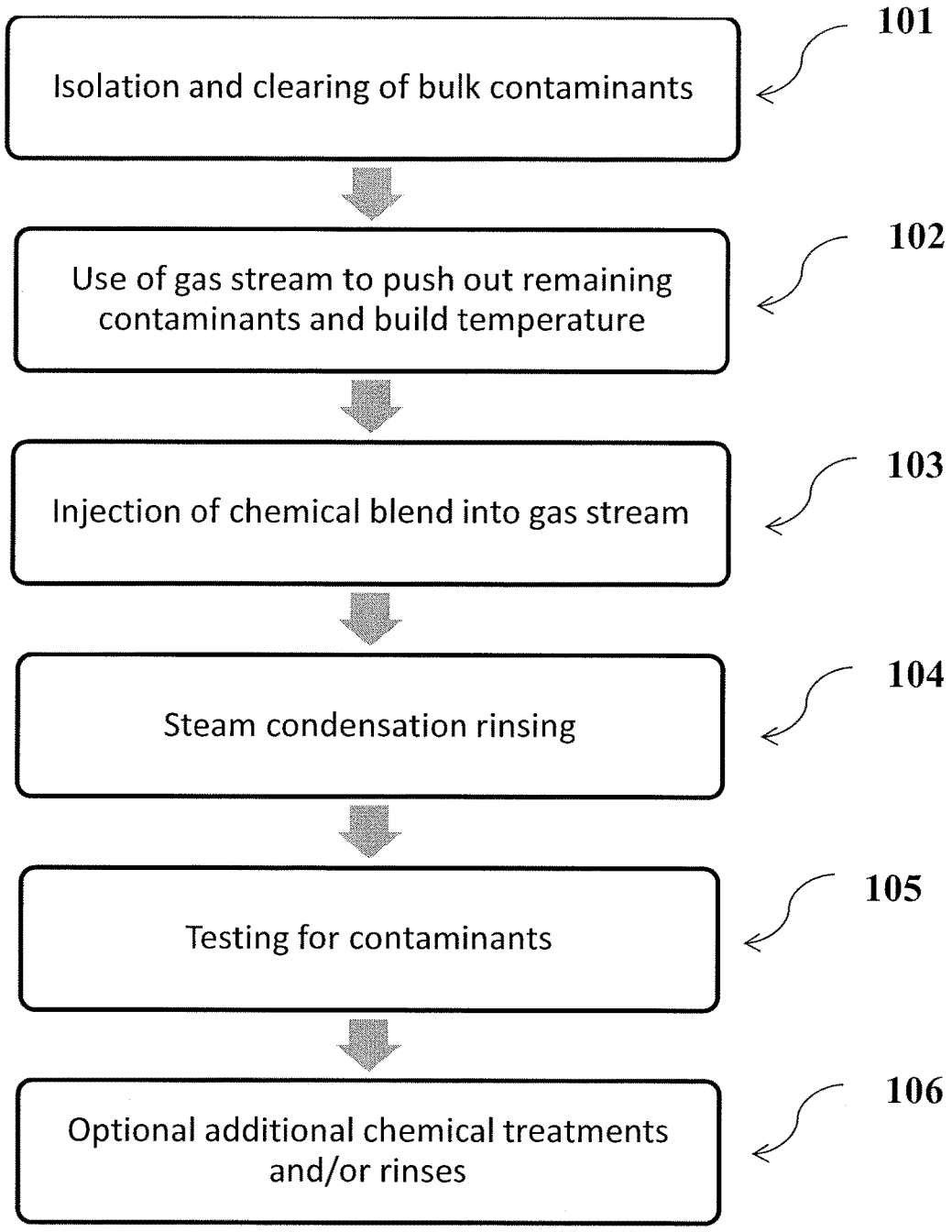
Isolation and clearing of bulk contaminants
101
Use of gas stream to push out remaining contaminants and build temperature
102
Injection of chemical blend into gas stream
103
Steam condensation rinsing
104
Testing for contaminants
105
Optional additional chemical treatments and/or rinses
106

DECONTAMINATION AND CLEANING PROCESS FOR HYDROCARBON CONTAMINATED EQUIPMENT

FIELD OF THE INVENTION

The present invention relates to improved processes for the cleaning of equipment contaminated with hydrocarbon material during turnaround periods at refineries, plants, and other facilities. The improved process decontaminates, cleans, and restores the operating efficiency of the contaminated equipment, while also allowing for faster equipment decontamination and cleaning at a significantly lower cost.

BACKGROUND OF THE INVENTION

Oil refineries, petrochemical plants, and other facilities that process hydrocarbons run equipment 24 hours a day, seven days a week to maximize efficiency. The goal of these facilities is to remain operational for as long as possible and to avoid downtime whenever feasible. However, regardless of continuous run times and steps taken to continue operations, all facilities must, at some point, stop operations to take the process equipment out of service for repairs, upgrades, and inspections. This activity is often called a "turnaround" and is a major event for the unit. The facilities experience significant financial loss for every hour that the equipment is out of service, so getting the equipment ready for maintenance as quickly as possible is desired.

During a turnaround, the equipment cannot merely be shut down and drained before performance of maintenance and inspections. Rather, several steps must be taken to decontaminate the equipment before the facility personnel may open and expose the equipment to the atmosphere. The facility must first stop the feed from entering the equipment and remove any material that is present within the internal structure. While the equipment may seem empty at this point and may be under a steam or nitrogen atmosphere, the system cannot be exposed to the air, due to the noxious qualities of the vapors remaining in the equipment. Indeed, before opening the equipment and exposing personnel to the noxious vapors, the facility must ensure the amount of each contaminant, for example, hydrogen sulfide ($H_2S$) and benzene, is within acceptable ranges set forth by government and facility regulations. The amount of each contaminant must be within a safe, acceptable level prior to opening the equipment to prevent any risk of fire, harmful exposure to personnel, or environmental damage. The contaminants are typically checked in the vapor space with meters or lab equipment and the equipment remains closed to the atmosphere until satisfactory readings are achieved. The process of lowering the amount of contaminants in the vapors to an acceptable level for the equipment to be exposed to the atmosphere and ready for personnel entry is called decontamination or cleaning.

Over the years, several methods have been developed to decontaminate or clean the equipment before exposing the equipment to the atmosphere or facility personnel. The most common decontamination process includes the use of steam, nitrogen, or air to strip out the contaminants. Many process vessels today have a hard piped steam connection that was used for this "steam-out" process. Over an extended period of time, any of these gas streams will lower the noxious vapor content of the equipment, but there are numerous limitations to this method. For instance, this "steam-out" process requires a substantial amount of time to initially clear noxious gases, such as hydrogen sulfide ($H_2S$), and benzene. Steaming a vessel could take more than a week to complete. Another downside of this process is the possibility of noxious vapors reappearing if personnel disturb any material in the equipment. Indeed, contaminants, such as benzene, can be trapped beneath scale or other waste product and seep out at later time (e.g., when cleaning had been considered completed).

An improved method for decontamination was developed that involves circulating an aqueous solution of a chemical cleaner, sometimes while also applying steam or heat. The makeup of the aqueous chemical cleaners is varied and includes such components as solvents, surfactants, scavengers, enzymes, acids, and caustics. Although each chemical blend can be quite different, the general method of applying these aqueous chemicals is similar. The process usually involves circulating the cleaning solution with pumps and testing the solution for when it is spent. During circulation, the gas content of the vessel is usually checked and the chemical cleaning is normally stopped when the contaminant vapor content reaches the desired ranges. This type of aqueous chemical cleaning results in cleaner equipment than steam or nitrogen purging with less reappearance of noxious gases. However, as with the previous method discussed above, there are deficiencies in this process. First, the volume of effluent waste generated can be significant and difficult to treat. Second, the time to completely treat a vessel remains long, often lasting several days. Third, the equipment is only cleaned where it is contacted with the liquid chemical cleaner. Much of a larger vessel may remain untreated due to poor distribution of the chemical cleaner, especially when liquid channeling occurs and with the bottom sides of equipment internals. Finally, the aqueous chemical solutions have a limited ability to dissolve or remove heavier hydrocarbon materials that are inside the equipment. This material may give off noxious fumes or hamper planned mechanical work or visual inspections.

Another cleaning process has also been used in the industry that utilizes terpene solvents. According to this process, terpene solvents are injected into equipment with steam and an additive package. The steps of this process are similar to the "steam-out" process, but include the additional step of injecting the terpene based chemical into the steam going into the equipment. In this process, no liquid circulation is required so equipment requirements are lower and the volume of effluent liquid generated is significantly less. This process is also faster than the previous methods discussed above, often decreasing the decontamination process by more than one day. However, the terpene solvent steam cleaning approach is very costly. While terpenes may have beneficial physical properties for use in the process, the raw material costs for terpenes are very high and are much more expensive than other cleaning solutions. In addition, because terpenes are not derived from crude oil, it is necessary for the refineries and plants to closely track the use of the terpene during the cleaning process. In particular, terpene is a volatile unsaturated hydrocarbon found in the essential oils of plants, especially conifers and citrus trees, which means that it has one or more unsaturated double bonds between the carbon atoms. Accordingly, since terpenes and other unsaturated hydrocarbons have high reactivity and a tendency to polymerize, unsaturated compounds generally would not be expected to be present in large quantities in crude petroleum. Thus, constant tracking of the terpene is necessary, but can be burdensome and time-consuming.

All of the above-mentioned processes have associated drawbacks and limitations that significantly hinder the speed and efficiency of the decontamination process during a turnaround. Accordingly, there remains a need for an improved process for the cleaning and decontamination of equipment during a turnaround that is faster, more efficient, and can be performed at a significantly lower cost.

SUMMARY OF THE INVENTION

The present invention is directed to a process for the decontamination of equipment taken out of service, including injecting a gas stream, for example, steam, into the equipment, wherein the equipment has an internal surface; injecting at least one solvent into the equipment in the presence of the gas stream, wherein the solvent has a Kauri-butanol (Kb) value of 80 or greater; injecting at least one surfactant into the equipment in the presence of the gas stream and the solvent; allowing the gas stream, solvent, and surfactant to condense on at least 85 percent of the internal surface to form a condensed liquid; and removing the condensed liquid from the equipment. The process may further include the step of atomizing the solvent and surfactant such that the solvent and surfactant are dispersed throughout the equipment. In one embodiment, the solvent is selected from the group consisting of xylene, benzene, alkylbenzene, toluene, and mixtures thereof. In another embodiment, the solvent may be an aromatic, aliphatic, paraffinic, naphthenic, polymeric, phenolic, or halogenated hydrocarbon compound. The solvent may be injected into the equipment in an amount of about 0.010 pounds to about 0.40 pounds per pound of steam. In yet another embodiment, the surfactant has a hydrophilic-lipophilic balance (HLB) ranging from about 6 to about 14.

The present invention is also directed to a process for the removal of noxious gases from an internal portion of equipment taken out of service, including clearing bulk contaminants from the equipment; injecting an amount of steam into the equipment sufficient to heat the internal portion of the equipment to a temperature of at least 212° F.; mixing at least one aromatic solvent and at least one surfactant to form a mixture; injecting the mixture of the aromatic solvent and the surfactant into the equipment in the presence of the steam, wherein the aromatic solvent has a Kauri-butanol (Kb) value of 90 or greater; atomizing the aromatic solvent and the surfactant such that the aromatic solvent and surfactant are dispersed throughout the internal portion of the equipment; allowing the steam and the mixture of the aromatic solvent and the surfactant to condense on the internal portion of the equipment to form a condensed liquid; and removing the condensed liquid from the equipment. The process may further include rinsing the condensed liquid via the steam injection or with water.

In one embodiment, the aromatic solvent has a boiling point of about 210° F. to about 400° F. For instance, the aromatic solvent may be selected from the group consisting of xylene, benzene, alkylbenzene, toluene, and mixtures thereof. In this aspect, the aromatic solvent may be injected into the equipment in an amount of about 0.010 pounds to about 0.40 pounds per pound of steam and the surfactant may be injected into the equipment in an amount of about 0.01 pounds to about 0.25 pounds per pound of solvent. The surfactant may be selected from the group consisting of alkylbenzene sulfonates, alkyl sulfates, alkyl ether sulfates, ethoxylates, polyethoxylates, carboxylic esters, polyethylene glycol esters, quaternary ammonium salts, alcohols, oxides, amides, amines, and mixtures thereof.

The present invention is further directed to a process for cleaning hydrocarbon contaminated equipment that has been taken out of service, including clearing bulk contaminants from the equipment; injecting an amount of steam into the equipment sufficient to heat an internal portion of the equipment to a temperature of at least 212° F.; injecting at least one aromatic solvent and at least one surfactant into the equipment in the presence of the steam, wherein the aromatic solvent is selected from the group consisting of xylene, benzene, alkylbenzene, toluene, and mixtures thereof; atomizing the aromatic solvent and the surfactant such that the aromatic solvent and surfactant are dispersed throughout the internal portion of the equipment; allowing the steam, aromatic solvent, and surfactant to condense within the internal portion of the equipment to form a condensed liquid; rinsing the condensed liquid from the equipment via the steam injection; and testing the internal portion of the equipment for contaminants. The process may also further include the steps of premixing the aromatic solvent and the surfactant prior to injection and premixing the aromatic solvent and the surfactant with the steam prior to injection.

In one embodiment, the aromatic solvent may be injected into the equipment in an amount of about 0.010 pounds to about 0.35 pounds per pound of steam and the surfactant may be injected into the equipment in an amount of about 0.05 pounds to about 0.20 pounds per pound of solvent. In another embodiment, the surfactant has a hydrophilic-lipophilic balance (HLB) ranging from about 6 to about 14. In yet another embodiment, the pressure within the internal portion of the equipment is about 10 psig to about 50 psig.

BRIEF DESCRIPTION OF THE DRAWINGS

Further features and advantages of the invention can be ascertained from the following detailed description that is provided in connection with the drawings described below:

FIG. 1 is a flowchart illustrating the steps of the process according to one embodiment of the present invention.

DETAILED DESCRIPTION OF THE INVENTION

The present invention is directed to an improved process for the cleaning of equipment contaminated with hydrocarbon material during turnaround periods, for example, periods when the equipment is out of service. In particular, the present invention relates to a process for removing noxious gases and cleaning hydrocarbon contaminants from equipment that is taken out of service including injecting a suitable solvent into the contaminated equipment with a gas stream, such as steam, and an additive. Advantageously, the combination of the steam and the chemical blend of the suitable solvent and additive dissolves harmful hydrocarbon material and removes noxious vapors from the equipment making it safe for facilities to allow personnel to access the internal portions of machinery. Indeed, according to the present invention, the solvent and additive condense in the equipment due to the steam flow. This, in turn, allows for the cleaning solution to penetrate equipment interstices and soak into heavier hydrocarbon deposits. Allowing the solvent to be mixed with the steam also results in better distribution, contact, and rinsing from the equipment. The use of the additive improves the cleaning ability of the solvent and also allows for the solvent to be mixed with steam and water.

The present invention for decontaminating equipment of noxious gases provides numerous beneficial results. For example, unlike the conventional "steam-out" process that requires a substantial amount of time to complete (e.g., about one week or more), the present invention can sufficiently clean contaminated equipment after a single injection of or treatment with the chemical blend.

In addition, contrary to the conventional aqueous chemical cleaning method discussed previously, the present invention provides a cleaning timeline that is significantly shorter, an effluent volume that is smaller and easier to treat, and higher efficiency since all surfaces on the equipment internals can be contacted and the solvency power of the chemical blend is higher. Indeed, due to the high solvency power and the lightweight nature of the solvents of the present invention, the present invention can remove greater amounts of contaminants using lower amounts of solvent and in shorter periods of time. For instance, the solvents of the present invention can remove at least about 10 pounds of contaminant per gallon of solvent. In another embodiment, the solvents of the present invention can remove at least about 11 pounds of contaminant per gallon of solvent. In still another embodiment, the solvents of the present invention can remove as much as about 12 pounds of contaminant per gallon of solvent. In contrast, a cleaning method involving terpene may result in removal of about 5 pounds of contaminant per gallon of terpene.

In this aspect, due to the solvency power, the solvents of the present invention can dissolve about 45 percent more contaminants than solvents based on non-aromatic compounds, such as terpenes. In another embodiment, the solvents of the present invention can dissolve about 50 percent more contaminants than solvents based on non-aromatic compounds. In yet another embodiment, the solvents of the present invention can dissolve about 55 percent more contaminants than solvents based on non-aromatic compounds. For example, the solvents of the present invention can dissolve about 60 percent more contaminants than solvents based on non-aromatic compounds.

Due to the advantageous properties of the solvents of the present invention, the present invention provides decontaminated equipment in less than about 48 hours, preferably less than about 24 hours. In some embodiments, the present invention may provide decontaminated equipment in less than about 12 hours. Indeed, the present invention allows the shutdown time to be reduced over prior methods by at least about 25 percent, preferably at least about 50 percent, and more preferably at least about 75 percent.

In addition, the effluent volume is about 50 percent less when compared to effluent volumes of the conventional aqueous cleaning methods. In another embodiment, the effluent volume is about 60 percent less when compared to effluent volumes of the conventional aqueous cleaning methods. In still another embodiment, the effluent volume is about 70 percent less when compared to effluent volumes produced in accordance with conventional aqueous cleaning methods. For example, the liquid effluent in a conventional aqueous chemical cleaning method is about 2 to about 10 times greater than the liquid effluent of the present invention. When compared to effluent volumes resulting from cleaning methods involving terpene, the effluent volume of the present invention is about 15 percent less. For instance, the effluent volume of the present invention is about 10 percent less when compared to effluent volumes of cleaning methods involving terpenes.

Due to the significantly smaller effluent volumes produced by the present invention, the present invention also provides effluents having lower contents of oxidizable organic matter, which is measured by the Chemical Oxygen Demand (COD). In one embodiment, during the solvent cleaning step, the effluents of the present invention have COD values of less than 20,000 ppm. In another embodiment, the effluents of the present invention have COD values of less than 10,000 ppm. In still another embodiment, the effluents of the present invention have COD values of less than 5,000 ppm. In yet another embodiment, after about two days, the effluents of the present invention will have COD values of 2,000 ppm or less.

Due to the lower amounts of solvent and shorter cleaning periods provided by the present invention, the effluents have COD values that are about 30 percent less than COD values of effluents resulting from cleaning methods involving terpenes. In another embodiment, the effluents of the present invention have COD values that are about 40 percent less than COD values of effluents resulting from cleaning methods involving terpenes. In still another embodiment, the effluents of the present invention have COD values that are about 50 percent less than COD values of effluents resulting from cleaning methods involving terpenes.

The present invention also provides a more efficient process since the chemical blend including the solvent can contact all surfaces and crevices of the equipment internals. For example, the surface coverage of the cleaner, i.e., combination of the steam and the chemical blend of the suitable solvent and additive, is at least 80 percent of the surface of the targeted equipment. In one embodiment, the surface coverage of the cleaner is at least about 85 percent. In another embodiment, the surface coverage of the cleaner is at least about 90 percent. In still another embodiment, the surface coverage of the cleaner is at least about 95 percent. In yet another embodiment, the surface coverage of the cleaner is at least about 99 percent. Indeed, the surface coverage of the cleaner is as much as 100 percent.

Furthermore, since the raw material costs of the chemical blend are significantly lower than that of conventional extractants such as terpenes, the present invention is an improvement over such methods mentioned above because the present invention is much more economical for commercial use. Accordingly, the present invention provides an improved process for the cleaning and decontamination of equipment during a turnaround that is faster, more efficient, and can be performed at a significantly lower cost.

Moreover, since the solvent used in accordance with the invention is naturally derived from hydrocarbon oil (unlike conventional extractants such as terpene), the need to track the use of the solvent during the cleaning process is less important. In fact, compounds such as benzene, toluene, xylene, and naphthalene may occur initially as components of the crude oil, or they may be derived from unstable compounds produced by mild cracking during the distilling process. In contrast, terpenes are not derived from hydrocarbon oil. As such, unlike terpene, the present invention reduces and/or dispenses with the need to track the usage of the solvent or extractant.

Referring to FIG. 1, the flowchart illustrates a detailed embodiment of a method for cleaning equipment contaminated with hydrocarbon material contemplated by the present invention. As used herein, the term, "equipment," includes any type of apparatus at a refinery, plant, or other facility in which materials are processed, stored, or transferred. Indeed, virtually any type of equipment that can be isolated with steam and chemicals may be cleaned in accordance with the present invention. The equipment may include one or more apparatus that are in fluid contact and cleaned together. Therefore, one skilled in the art will understand that the scope of the invention is not intended to be limited to cleaning any specifically identified equipment identified herein.

At step 101, the equipment to be decontaminated is isolated and cleared of any solid or liquid material present within the internal housing structure. In one embodiment, the material may be removed with an outlet path, for example, a pump located at the bottom of the equipment. In another embodiment, a nitrogen or steam gas stream may be used to push out any remaining bulk material and minimize the residual contaminants that must be treated with the chemical blend of the present invention. Furthermore, the equipment may be completely emptied by draining and pumping the equipment using standard shut down procedures that will be known to those skilled in the art.

In one embodiment, the total time for step 101 is about one hour to about 36 hours. In another embodiment, step 101 takes about four hours to about 24 hours to complete. In yet another embodiment, step 101 takes about eight hours to about 20 hours to complete.

After the equipment has been emptied of the majority of the bulk contaminants, a gas stream is injected into the equipment to push out the remaining liquid and contaminants and build temperature in the system (step 102). In one embodiment, the gas stream may include steam. The use of steam is advantageous due to its low cost, high availability, and high energy capacity to heat up the system. Steam also advantageously provides water condensate for rinsing equipment. While the embodiments described herein exemplify the use of steam as the gas stream, one of ordinary skill in the art would recognize that other gases, such as nitrogen, carbon dioxide, and natural gas, may also be suitable for use with the present invention.

While steam lines are often readily available in most facilities, the steam may be connected to the equipment in any suitable manner known to those of ordinary skill in the art.

For example, in one embodiment, the steam may already be connected to the equipment in the form of a "steam out" line. In another embodiment, the steam may be connected from a steam distribution "header" of another steam source already in the vicinity. In still another embodiment, the steam may be generated with a boiler as needed for the application.

In this aspect of the invention, when the steam is injected into the equipment, any amount of steam volume and pressure may be utilized as long as the volume and pressure are sufficient to ensure the equipment to be cleaned is able to be heated up and the chemical blend is distributed properly throughout the equipment. For example, in one embodiment, the pressure of the steam is about 40 psig to about 500 psig. In another embodiment, the pressure of the steam is about 100 psig to about 350 psig. In still another embodiment, the pressure of the steam is about 150 psig to about 300 psig. In addition, the steam lines should have steam temperatures of at least about 250° F. to about 450° F. In one embodiment, the steam lines should have steam temperatures between about 300° F. and 425° F. In another embodiment, the steam lines should have steam temperatures between about 350° F. and 450° F.

While the steam is injected into the equipment, the equipment will build a positive pressure. This, in turn, allows for non-condensable gases to be pushed out, liquid levels to be drained, and the temperature of the equipment to be controlled. The temperature and pressure maintained within the equipment may vary depending on the system design and limitations and the need to push gas and liquid streams out of the equipment. Indeed, one of ordinary skill in the art will be able to determine an appropriate pressure and temperature range for the equipment to be cleaned based on the system design and requirements. In one embodiment, the pressure within the equipment may range from about 1 psig to about 150 psig. In another embodiment, the pressure within the equipment may range from about 10 psig to about 100 psig. In still another embodiment, the pressure within the equipment may range from about 10 psig to about 50 psig. The pressure within the equipment may be controlled or adjusted by any means available to one of ordinary skill in the art. For example, equipment pressures may be controlled by adjusting the steam and gas inputs and/or adjusting the vents and drains on the equipment.

As the gas stream pushes out the remaining liquid, low point liquids, including both hydrocarbons and steam condensate, are drained out of the low points in the system. For example, the low point liquids may drain into an effluent processing system. Due to the risk of over pressuring or forming a vacuum on the equipment, a steam or nitrogen source should always be flowing through the equipment and a vent or drain point should always be open.

Once the liquids have been cleared out of the system, the steam is allowed to continue heating up the system until a sufficient temperature is reached to ensure that the steam and chemical solvent are able to condense on the equipment and allow for cleaning to occur. In this aspect, the steam should be allowed to continue heating up the system until a suitable temperature is achieved constantly throughout the equipment such that at least 90 percent, preferably at least about 95 percent, and more preferably at least about 99 percent of the equipment is at the desired temperature. In one embodiment, the steam should be allowed to continue heating up the system until a temperature of at least 210° F. is achieved at all locations throughout the equipment. In still another embodiment, the steam should be allowed to continue heating up the system until a temperature of at least 220° F. is achieved at all locations throughout the equipment.

Once the equipment is at the proper temperature, at step 103, a predetermined volume of the solvent of the present invention is injected into the gas stream entering the equipment. In this aspect, a chemical blend of at least one suitable solvent and at least one additive may be injected into the gas stream entering the equipment. In another embodiment, the additive is not present in the stream entering the equipment, but is present in the equipment such that the chemical blend exists during the contaminant cleaning portion of the process.

Once the solvent, gas stream, and additive are introduced into the equipment, the chemical blend and the gas stream are dispersed throughout the equipment based on the atomization of the chemicals. Due to the heating of the system by the steam and the use of aromatic solvents, the chemical components of the chemical blend are able to condense and clean the contaminants trapped within the equipment. Indeed, the present invention allows the chemical components to seep into cracks and crevices of the equipment internals and break down "hard to get" contaminants. As such, unlike prior art methods, the cleaner, i.e., the combination of the steam and the chemical blend of the suitable solvent and additive, contacts at least 80 percent of the interior surface of the targeted equipment. In one embodiment, the cleaner contacts at least about 85 percent of the interior surface of the targeted equipment. In another embodiment, at least about 90 percent of the interior surface of the targeted equipment is contacted by the cleaner. In still another embodiment, the cleaner contacts at least about 99 percent of the interior surface of the targeted equipment.

According to one embodiment of the present invention, the chemical blend, i.e., the solvent and at least one additive, is injected into the equipment simultaneously with the steam. In this aspect, the chemical blend may be injected directly into the steam. In another embodiment, the chemical blend may be premixed with the steam and then injected into the equipment. In still another embodiment, the chemical blend may be injected into the equipment separately from the steam. Indeed, as long as the solvent is present in the equipment in vaporized or atomized form, the chemical blend may be injected into the equipment by any method known by those skilled in the art.

When injecting the chemical blend into the equipment with the steam, the ratio of solvent to steam may vary. However, in one embodiment, the solvent is used in an amount of about 0.010 pounds to about 0.40 pounds of solvent per pound of steam injected into the system. In another embodiment, the solvent is used in an amount of about 0.015 pounds to about 0.35 pounds of solvent per pound of steam injected into the system. In still another embodiment, the solvent is used in an amount of about 0.02 pounds to about 0.25 pounds of solvent per pound of steam injected into the system. In yet another embodiment, the solvent is used in an amount of about 0.10 pounds to about 0.20 pounds of solvent per pound of steam injected into the system.

Similar to the solvent, the additive may be injected into the equipment by any method known by those skilled in the art as long as the solvent and additive are present in the equipment in vaporized or atomized form. For example, in one embodiment, the additive may be premixed with the solvent in a chemical solution and then injected into the equipment as a mixture simultaneously with the steam. In another embodiment, the additive may be injected directly into the steam. In still another embodiment, the additive may be injected into the equipment separately from both the steam and the solvent. In yet another embodiment, the additive may be premixed with the solvent and the steam prior to injection into the equipment. In yet another embodiment, the additive is already present in the equipment when the solvent is introduced into the equipment.

When injecting the additive into the equipment with the solvent and the steam, the ratio of additive to solvent may vary. In one embodiment, the additive is used in an amount of about 0.01 pounds to about 0.25 pounds per pound of solvent injected into the system. In another embodiment, the additive is used in an amount of about 0.05 pounds to about 0.20 pounds per pound of solvent injected into the system. In still another embodiment, the additive is used in an amount of about 0.10 pounds to about 0.20 pounds per pound of solvent injected into the system. In yet another embodiment, the additive is used in an amount of about 0.10 pounds to about 0.15 pounds per pound of solvent injected into the system.

In this aspect of the invention, the chemical blend and gas stream may be injected into the equipment at different locations to provide for a more thorough and efficient cleaning. For example, the chemical blend and gas stream may be injected into the equipment using a number of different injection ports. In one embodiment, at least two injection ports in the targeted equipment are used to introduce the cleaner into the equipment. In another embodiment, at least three injection ports in the targeted equipment are used to introduce the cleaner into the equipment. In yet another embodiment, at least four injection ports in the targeted equipment are used to introduce the cleaner into the equipment. In still another embodiment, a first injection port is used to introduce the additive into the equipment and a second injection port is used to introduce the solvent and gas stream.

In another embodiment, as many as 20 different injection ports are used to inject the chemical blend and gas stream into the targeted equipment. For example, the present invention contemplates the cleaning of industrial heaters used in refineries, plants, and other facilities. The industrial heater may have a plurality of tubes into which the steam and cleaner, i.e., the combination of the steam and the chemical blend of the suitable solvent and additive, are injected. In this aspect, the industrial heater may have at least eight different tubes, for example, at least ten different tubes, into which the steam and the cleaner are injected. Each tube may include at least one injection port. In another embodiment, each tube may include at least two injection ports.

The injection of the chemical blend into the gas stream may continue for any period of time that is sufficient to reduce and clean the contaminants by the presence of the steam and the chemical blend. For instance, the injection of the steam and the chemical blend may continue for about ten minutes to about six hours. In another embodiment, the injection of the steam and the chemical blend may continue for about 30 minutes to about four hours. In still another embodiment, the injection of the steam and the chemical blend may continue for about one hour to about three hours.

After the chemical blend has been injected, the steam injection is continued for a predetermined amount of time to allow for condensation rinsing of the equipment (step 104). In one embodiment, the condensation rinsing may continue for about five minutes to about four hours. In another embodiment, the condensation rinsing may continue for about 30 minutes to about three hours. In yet another embodiment, the condensation rinsing may continue for about one hour to about two hours.

Once the steam condensation rinsing is complete, at step 105, the equipment may be tested for contaminants. In this aspect, the equipment may be switched over to a nitrogen environment and then tested for contaminants. If contaminant levels are above a specified range, additional treatments and/or rinses may be applied to the equipment (step 106). For example, the system can be steam or nitrogen purged. Also, in another embodiment, additional injections of the chemical blend may be applied and the system may be retested. In this aspect, a liquid water rinse can be applied either before or after the testing to improve the removal of contaminants from the system. Additional chemical treating in the form of pyrophoric treatment or inorganic scale removal can occur after completion of the chemical cleaning and before or after gas testing. When the testing is completed and the amount of contaminants within the equipment is determined to be at a safe level, the equipment may be opened to the atmosphere for performance of inspection/maintenance or left under a nitrogen blanket.

The total time for step 101 through step 105 may be about 6 hours to about 48 hours. In one embodiment, the total time for step 101 to step 105 is from about 12 hours to about 36 hours. In another embodiment, the total time for step 101 to step 105 is from about 18 hours to about 24 hours.

According to one embodiment of the present invention, the chemical blend includes at least one suitable solvent and at least one additive. The present invention contemplates the use of an aromatic solvent or a solvent having a high aromatic content. Examples of aromatic solvents contemplated by the present invention include, but are not limited to, benzene, alkylbenzene, toluene, toluene TDI, xylene, m-xylene, p-xylene and o-xylene. Such aromatic solvents are advantageous to the present invention due to their high solvency strength and low cost. In another embodiment, the solvent in the chemical blend may be any aromatic, aliphatic, paraffinic, naphthenic, polymeric, phenolic, or halogenated hydrocarbon compounds.

In this aspect, the present invention contemplates the use of solvents having high solvency strength or high Kauri-butanol (Kb) values. As known to those of ordinary skill in the art, the Kb value is a measure of solvent power for a hydrocarbon solvent. The greater the Kb value, the higher the dissolving power of the solvent. Without being bound by any particular theory, it is believed that the aromatic solvents of the present invention having high Kb values provide faster and more efficient cleaning of "hard to get" contaminants, such as polymers, gums, resins and heavy hydrocarbon materials such as asphaltenes. For instance, the present invention contemplates solvents having a Kb value of 80 or greater. In another embodiment, solvents having a Kb value of 85 or greater are contemplated by the present invention. In still another embodiment, solvents having a Kb value of 90 or greater are contemplated by the present invention. In yet another embodiment, solvents of the present invention have a Kb value of 95 or greater. For example, in this aspect of the invention, the Kb value of suitable solvents for use with the present invention ranges from about 95 Kb to about 105 Kb.

Due to their high Kb values, the solvents of the present invention have a dissolving power that is about 40 percent stronger than that of solvents used in conventional cleaning methods. In another embodiment, the solvents of the present invention have a dissolving power that is about 45 percent stronger than that of solvents used in conventional cleaning methods. In still another embodiment, the solvents of the present invention have a dissolving power that is about 50 percent stronger than that of solvents used in conventional cleaning methods.

Accordingly, the effectiveness of the present invention may be quantified in a number of other ways including the following equation:

$$\text{Solvency Strength(Kb)/overall cleaning time}(t_c) \quad (1)$$

For example, in one embodiment, equation (1) ranges from about 1.6 Kb/hour to about 4.4 Kb/hour. In another embodiment, equation (1) ranges from about 1.7 Kb/hour to about 4.2 Kb/hour. In yet another embodiment, equation (1) ranges from about 1.8 Kb/hour to about 4 Kb/hour. In still another embodiment, equation (1) ranges from about 1.9 Kb/hour to about 4 Kb/hour.

In addition, equation (2) below also is a measure of effectiveness of the present invention:

$$\text{Contaminant Removal(lbs/gal)/(Solvency Strength (Kb)*overall cleaning time}(t_c)) \quad (2)$$

In one embodiment, equation (2) is at least about 0.002 lbs/gal*hr. In another embodiment, equation (2) ranges from about 0.002 lbs/gal*hr to about 0.006 lbs/gal*hr. Indeed, equation (2) may range from about 0.003 lbs/gal*hr to about 0.006 lbs/gal*hr. For example, equation (2) may ranges from about 0.004 lbs/gal*hr to about 0.005 lbs/gal*hr.

Indeed, to allow for the best solvent condensation on the equipment surfaces, any solvent or mixture of solvents having the Kb values discussed above and a boiling point in the range of about 100° F. to about 600° F. is contemplated by the present invention. For example, any solvent or mixture of solvents with a boiling point in the range of about 210° F. to about 450° F. is contemplated by the present invention. Indeed, the solvent or mixture of solvents may have a boiling point in the range of about 212° F. to about 350° F. Similarly, suitable solvents for use with the present invention include solvents having a latent heat of vaporization of between about $3.2\times10^5$ J/kg to about $4.0\times10^5$ J/kg. In one embodiment, the latent heat of vaporization of the solvent is about $3.3\times10^5$ J/kg to about $3.95\times10^5$ J/kg.

The solvent of the present invention may be utilized as a mixture of one or more of any of the above-mentioned aromatic solvents, one or more of any of the above-mentioned hydrocarbon solvents, and/or one or more conventional solvents. For example, the present invention contemplates a mixture of at least two aromatic solvents. In one embodiment, the solvent may include a mixture of xylene and at least one other aromatic solvent, for example, benzene or toluene. In this aspect, the xylene may be present in the mixture in an amount of about 1 percent to about 99 percent by weight based on the total weight of the solvent mixture. In another embodiment, the xylene may be present in the mixture in an amount of about 10 percent to about 95 percent by weight based on the total weight of the solvent mixture. In still another embodiment, the xylene may be present in the mixture in an amount of about 20 percent to about 90 percent by weight based on the total weight of the solvent mixture.

In another embodiment, the solvent may include a mixture of toluene and at least one other aromatic solvent, for example, xylene or benzene. In this aspect, the toluene may be present in the mixture in an amount of about 1 percent to about 99 percent by weight based on the total weight of the solvent mixture. In another embodiment, the toluene may be present in the mixture in an amount of about 10 percent to about 95 percent by weight based on the total weight of the solvent mixture. In still another embodiment, the toluene may be present in the mixture in an amount of about 20 percent to about 90 percent by weight based on the total weight of the solvent mixture.

In still another embodiment, the solvent may include a mixture of benzene and at least one other aromatic solvent, for example, xylene or toluene. In this aspect, the benzene may be present in the mixture in an amount of about 1 percent to about 99 percent by weight based on the total weight of the solvent mixture. In another embodiment, the benzene may be present in the mixture in an amount of about 10 percent to about 95 percent by weight based on the total weight of the solvent mixture. In still another embodiment, the benzene may be present in the mixture in an amount of about 20 percent to about 90 percent by weight based on the total weight of the solvent mixture.

In another embodiment, the present invention contemplates a mixture of at least one aromatic solvent and at least one other solvent. For example, the solvent of the present invention may be a mixture of at least one aromatic solvent and at least one of an aromatic, aliphatic, paraffinic, naphthenic, polymeric, phenolic, or halogenated hydrocarbon compound. In this aspect, the solvent may include a mixture of at least one of xylene, toluene, or benzene and a naphthenic compound. In another embodiment, the solvent may include a mixture of at least one of xylene, toluene, or benzene and a paraffinic compound. In still another embodiment, the solvent may include a mixture of at least one of xylene, toluene, or benzene and a different aromatic compound.

In this aspect, the other solvent may be present in the mixture in an amount of about 1 percent to about 95 percent based on the total weight of the solvent mixture. In another embodiment, the other solvent may be present in the mixture in an amount of about 5 percent to about 90 percent based on the total weight of the solvent mixture. In still another embodiment, the other solvent may be present in the mixture in an amount of about 10 percent to about 80 percent based on the total weight of the solvent mixture. In yet another embodiment, the other solvent may be present in the mixture in an amount of about 15 percent to about 75 percent based on the total weight of the solvent mixture.

In still another embodiment, the present invention contemplates a mixture of at least one aromatic solvent, for example, toluene, benzene, or xylene, and at least one conventional solvent. Conventional solvents may include any non-aromatic solvents. In this aspect, the aromatic solvent may be present in the mixture in an amount of about 1 percent to about 99 percent by weight based on the total weight of the solvent mixture. In another embodiment, the aromatic solvent may be present in the mixture in an amount of about 5 percent to about 95 percent by weight based on the total weight of the solvent mixture. In still another embodiment, the aromatic solvent may be present in the mixture in an amount of about 10 percent to about 90 percent by weight based on the total weight of the solvent mixture. In yet another embodiment, the aromatic solvent may be present in the mixture in an amount of about 15 percent to about 85 percent by weight based on the total weight of the solvent mixture.

The additive in the chemical blend improves the chemical's wetting, detergency, and ability to be rinsed by the steam condensate. Examples of suitable additives contemplated by the present invention include, but are not limited to, surfactants, scavengers, oxidizers, chelating agents, and any other type of product for improving the wetting and detergency of the chemical. In one embodiment, the additive includes at least one surfactant. Any type of surfactant having a hydrophilic-lipophilic balance (HLB) from about 6 to about 14 and having a boiling point/vapor pressure similar to the selected solvent is contemplated by the present invention. In this aspect, the surfactant may be anionic, cationic, non-ionic, or a mixture thereof. For example, surfactants contemplated by the present invention may include, but are not limited to, alkylbenzene sulfonates, alkyl sulfates, alkyl ether sulfates, ethoxylates, polyethoxylates, carboxylic esters, polyethylene glycol esters, quaternary ammonium salts, alcohols, oxides, amides, and amines. As would be recognized by those of ordinary skill in the art, any compound that lowers surface tension may be used as a surfactant in the present invention.

The chemical blend may include the solvent in any amount sufficient to thoroughly clean the equipment internals. For example, the solvent may be present in the chemical blend in an amount of about 80 percent to about 99 percent by weight based on the total weight of the chemical blend. In another embodiment, the solvent may be present in the chemical blend in an amount of about 85 percent to about 98 percent by weight based on the total weight of the chemical blend. In still another embodiment, the solvent may be present in the chemical blend in an amount of about 90 percent to about 95 percent by weight based on the total weight of the chemical blend.

In this same regard, the chemical blend may include the additive in any amount sufficient to provide wetting and detergency properties. For instance, the additive may be present in the chemical blend in an amount of about 1 percent to about 20 percent by weight based on the total weight of the chemical blend. In another embodiment, the additive may be present in the chemical blend in an amount of about 2 percent to about 15 percent by weight based on the total weight of the chemical blend. In still another embodiment, the additive may be present in the chemical blend in an amount of about 5 percent to about 10 percent by weight based on the total weight of the chemical blend.

According to the present invention, the chemical blend, including the solvent and the additive, may be aqueous or non-aqueous. When the chemical blend is aqueous, any amount of water content is acceptable with the present invention. However, in one embodiment, the water content may range from about 0 percent to about 90 percent of the total chemical volume. In another embodiment, the water content may range from about 10 percent to about 80 percent of the total chemical volume. In still another embodiment, the water content may range from about 15 percent to about 70 percent.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A process for the decontamination of equipment comprising:

taking the equipment out of service;

emptying bulk contaminants from the equipment;

clearing liquids and remaining contaminants from the equipment, wherein the liquids and remaining contaminants comprise processing fluids and hydrocarbons;

eliminating noxious gases from the equipment consisting of the steps of:

injecting a gas stream into the equipment, wherein the equipment has an internal surface;

injecting at least one solvent into the equipment in the presence of the gas stream, wherein the at least one solvent is selected from the group consisting of xylenes, benzene, alkylbenzene, toluene, and mixtures thereof;

injecting at least one surfactant into the equipment in the presence of the gas stream and the at least one solvent;

allowing the gas stream, the at least one solvent, and the at least one surfactant to condense on at least 85 percent of the internal surface to form a condensed liquid; and removing the condensed liquid from the equipment, opening the equipment to the atmosphere.

2. The process of claim 1, wherein the at least one solvent is selected from the group consisting of xylenes, toluene, and mixtures thereof.

3. The process of claim 1, wherein the at least one solvent is injected into the equipment with at least one other solvent selected from the group consisting of an aliphatic, paraffinic, naphthenie, polymeric, phenolic, and halogenated hydrocarbon compound.

4. The process of claim 1, wherein the gas stream comprises steam.

5. The process of claim 4, wherein the at least one solvent is injected into the equipment in an amount of about 0.010 pounds to about 0.40 pounds per pound of steam.

6. The process of claim 1, wherein the at least one surfactant has a hydrophilic-lipophilic balance (HLB) ranging from about 6 to about 14.

7. The process of claim 1, further comprising: atomizing the at least one solvent and the at least one surfactant such that the at least one solvent and the at least one surfactant are dispersed throughout the equipment.

8. A process for the removal of noxious gases from an internal portion of equipment during a turnaround, comprising:

taking the equipment out of service;

clearing bulk solids and fluid from the equipment;

injecting an amount of steam into the equipment sufficient to heat the internal portion of the equipment to a temperature of at least 212° F.;

mixing at least one aromatic solvent and at least one surfactant to form a mixture;

injecting the mixture of the at least one aromatic solvent and the at least one surfactant into the equipment in the presence of the steam, wherein the at least one aromatic solvent is selected from the group consisting of xylenes, benzene, alkylbertzene, toluene, and mixtures thereof;

atomizing the at least one aromatic solvent and the at least one surfactant such that the at least one aromatic solvent and the at least one surfactant are dispersed throughout the internal portion of the equipment;

allowing the steam and the mixture of the at least one aromatic solvent and the at least one surfactant to condense on the internal portion of the equipment to form a condensed liquid; and removing the condensed liquid from the equipment.

9. The process of claim 8, wherein the at least one aromatic solvent is selected from the group consisting of xylenes, toluene, and mixtures thereof.

10. The process of claim 8, wherein the step of removing the condensed liquid further comprises rinsing the condensed liquid via the steam injection.

11. The process of claim 8, wherein the step of removing the condensed liquid further comprises rinsing the condensed liquid with water.

12. The process of claim 8, wherein the at least one surfactant is selected from the group consisting of alkylbenzene sulfonates, alkyl sulfates, alkyl ether sulfates, ethoxylates, polyethoxylates, carboxylic esters, polyethylene glycol esters, quaternary ammonium salts, alcohols, oxides, amides, amines, and mixtures thereof.

13. The process of claim 8, wherein the at least one aromatic solvent is injected into the equipment in an amount of about 0.010 pounds to about 0.40 pounds per pound of steam and the at least one surfactant is injected into the equipment in an amount of about 0.01 pounds to about 0.25 pounds per pound of solvent.

14. A process for cleaning hydrocarbon contaminated equipment during a turnaround, comprising:

taking the equipment out of service;

clearing bulk contaminants from the equipment;

cleaning any remaining contaminants from the equipment consisting of the steps of:

injecting an amount of steam into the equipment sufficient to heat an internal portion of the equipment to a temperature of at least 212° F.;

injecting at least one aromatic solvent and at least one surfactant into the equipment in the presence of the steam, wherein the at least one aromatic solvent is selected from the group consisting of xylenes, benzene, alkylbenzene, toluene, and mixtures thereof;

atomizing the at least one aromatic solvent and the at least one surfactant such that the at least one aromatic solvent and the at least one surfactant are dispersed throughout the internal portion of the equipment;

allowing the steam, the at least one aromatic solvent, and the at least one surfactant to condense within the internal portion of the equipment to form a condensed liquid;

rinsing the condensed liquid from the equipment via the steam injection; and testing the internal portion of the equipment for contaminants.

15. The process of claim 14, further comprising: premixing the at least one aromatic solvent and the at least one surfactant prior to injection.

16. The process of claim 14, further comprising: premixing the at least one aromatic solvent and the at least one surfactant with the steam prior to injection.

17. The process of claim 14, wherein the at least one aromatic solvent is injected into the equipment in an amount of about 0.010 pounds to about 0.35 pounds per pound of steam and the at least one surfactant is injected into the equipment in an amount of about 0.05 pounds to about 0.20 pounds per pound of solvent.

18. The process of claim 14, the at least one surfactant has a hydrophilic-lipophilic balance (HLB) ranging from about 6 to about 14.

19. The process of claim 14, wherein the pressure within the internal portion of the equipment is about 10 prig to about 50 psig.

* * * * *